US009689078B2

(12) United States Patent
Bhavaraju et al.

(10) Patent No.: US 9,689,078 B2
(45) Date of Patent: Jun. 27, 2017

(54) PRODUCTION OF VALUABLE CHEMICALS BY ELECTROREDUCTION OF CARBON DIOXIDE IN A NASICON CELL

(71) Applicant: Ceramatec, Inc., Salt Lake City, UT (US)

(72) Inventors: Sai Bhavaraju, West Jordan, UT (US); James Mosby, Salt Lake City, UT (US)

(73) Assignee: CERAMATEC, INC., Salt Lake City, UT (US)

( * ) Notice: Subject to any disclaimer, the term of this patent is extended or adjusted under 35 U.S.C. 154(b) by 0 days.

(21) Appl. No.: 14/198,289

(22) Filed: Mar. 5, 2014

(65) Prior Publication Data

US 2014/0251822 A1 Sep. 11, 2014

Related U.S. Application Data

(60) Provisional application No. 61/773,616, filed on Mar. 6, 2013.

(51) Int. Cl.
*C25B 9/08* (2006.01)
*C25B 3/04* (2006.01)

(52) U.S. Cl.
CPC . *C25B 9/08* (2013.01); *C25B 3/04* (2013.01)

(58) Field of Classification Search
CPC ..... C25B 1/02–1/12; C25B 3/04; C25B 9/08
See application file for complete search history.

(56) References Cited

U.S. PATENT DOCUMENTS

2009/0134040 A1 5/2009 Gordon et al.
2011/0114502 A1 5/2011 Cole et al.
2012/0048730 A1 3/2012 Hartvigsen et al.
2012/0123168 A1 5/2012 Bhavaraju
2012/0171583 A1* 7/2012 Bocarsly et al. ..... 429/413
2012/0175267 A1* 7/2012 Bhavaraju ..... C25B 1/26 205/412
2013/0105330 A1* 5/2013 Teamey et al. ..... 205/349
2013/0118909 A1* 5/2013 Kaczur et al. ..... 205/349
2013/0118911 A1* 5/2013 Sivasankar et al. ..... 205/455
2013/0183546 A1* 7/2013 Joshi et al. ..... 429/50

FOREIGN PATENT DOCUMENTS

JP 2004174369 6/2004

OTHER PUBLICATIONS

Kazushiro, et al., "Bibliographic data and English Abstract", Japanese Patent Publication JP2004174369, (Jun. 24, 2004),1-2.
Shin, Ju C., "International Search Report", PCT Application No. PCT/US2014/020840 (Corresponding to U.S. Appl. No. 14/198,289), (Jul. 28, 2014),1-4.
Shin, Ju C., "Written Opinion of the International Searching Authority", PCT Application No. PCT/US2014/020840 (Corresponding to U.S. Appl. No. 14/198,289), (Jul. 28, 2014),1-7.

* cited by examiner

*Primary Examiner* — Ciel Thomas
(74) *Attorney, Agent, or Firm* — Paul S. Cha

(57) ABSTRACT

A NaSICON cell is used to convert carbon dioxide into a usable, valuable product. In general, this reaction occurs at the cathode where electrons are used to reduce the carbon dioxide, in the presence of water and/or hydrogen gas, to form formate, methane, ethylene, other hydrocarbons and/or other chemicals. The particular chemical that is formed depends upon the reaction conditions, the voltage applied, etc.

7 Claims, 10 Drawing Sheets

PRODUCTION OF VALUABLE CHEMICALS BY ELECTROREDUCTION OF CARBON DIOXIDE IN A NASICON CELL

CROSS-REFERENCE TO RELATED APPLICATIONS

This application claims the benefit of U.S. Provisional Application No. 61/773,616, filed Mar. 6, 2013, entitled "Production of Valuable Chemicals by Electroreduction of $CO_2$ in a NaSICON Cell," the entire disclosure of which is hereby incorporated by reference.

BACKGROUND OF THE INVENTION

Carbon dioxide ($CO_2$) is a naturally occurring chemical that is found in the atmosphere. This chemical is also produced as a byproduct in many chemical processes. Because of its natural abundance, it is readily available and inexpensive.

At the same time, many environmentalists are concerned over emissions of $CO_2$ and the impact such emissions may have on the global climate and environment.

Accordingly, there is a need in the industry for a new way to "fix" or treat $CO_2$ so that it is converted into a usable, chemically valuable chemical (such as, for example, a fuel.) Such a process is disclosed herein.

BRIEF SUMMARY OF THE INVENTION

The present embodiments relate to using a NaSICON (or other similar type electrochemical cell) as a means of "fixing" $CO_2$— e.g., converting the $CO_2$ into a valuable chemical, such as a hydrocarbon fuel, a base, etc. In general, this conversion reaction will occur in the cathode side of a NaSICON cell. As known in the industry, the NaSICON membrane will separate the cell into an anode compartment and a cathode compartment. Thus, the carbon dioxide will be reacted with an alkali metal, hydrogen gas and/or water in the cathode compartment (along with electrons) such that the carbon dioxide is fixed and converted into a usable product.

Because the NaSICON membrane isolates the cathode compartment from the anode compartment, specific advantages are obtained. These advantages include:

- two separate environments for different reaction conditions—for example, the anolyte may be non-aqueous, while the catholyte is aqueous (and vice versa);
- anolyte may be at a higher temperature than the catholyte (and vice versa);
- anolyte may be pressurized and catholyte not (and vice versa);
- anolyte may be irradiated and catholyte not (and vice versa);
- anolyte and/or anode may be designed to conduct specific reactions that are not dependent upon the catholyte and/or cathode reactions (and vice versa);
- the different chambers may have different flow conditions, solvents, solubilities, product retrieval/separation mechanisms, polarities, etc.

The ability to have separate reaction conditions in the anolyte compartment and catholyte compartment may allow the reactions in each compartment to be tailored to achieve optimal results.

Generally, any desired or chosen reaction may occur in the anode compartment of the cell, provided that there is an electrolyte within the anode compartment that includes alkali metal ions (sodium ions) that will transport across the membrane (e.g., the NaSICON membrane) and enter the cathode compartment. Some of these compounds include NaOH, NaCl, $Na_2CO_3$, etc.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the Figures, is not intended to limit the scope of the invention, as claimed, but is merely representative of embodiments of the invention.

Figure 1:
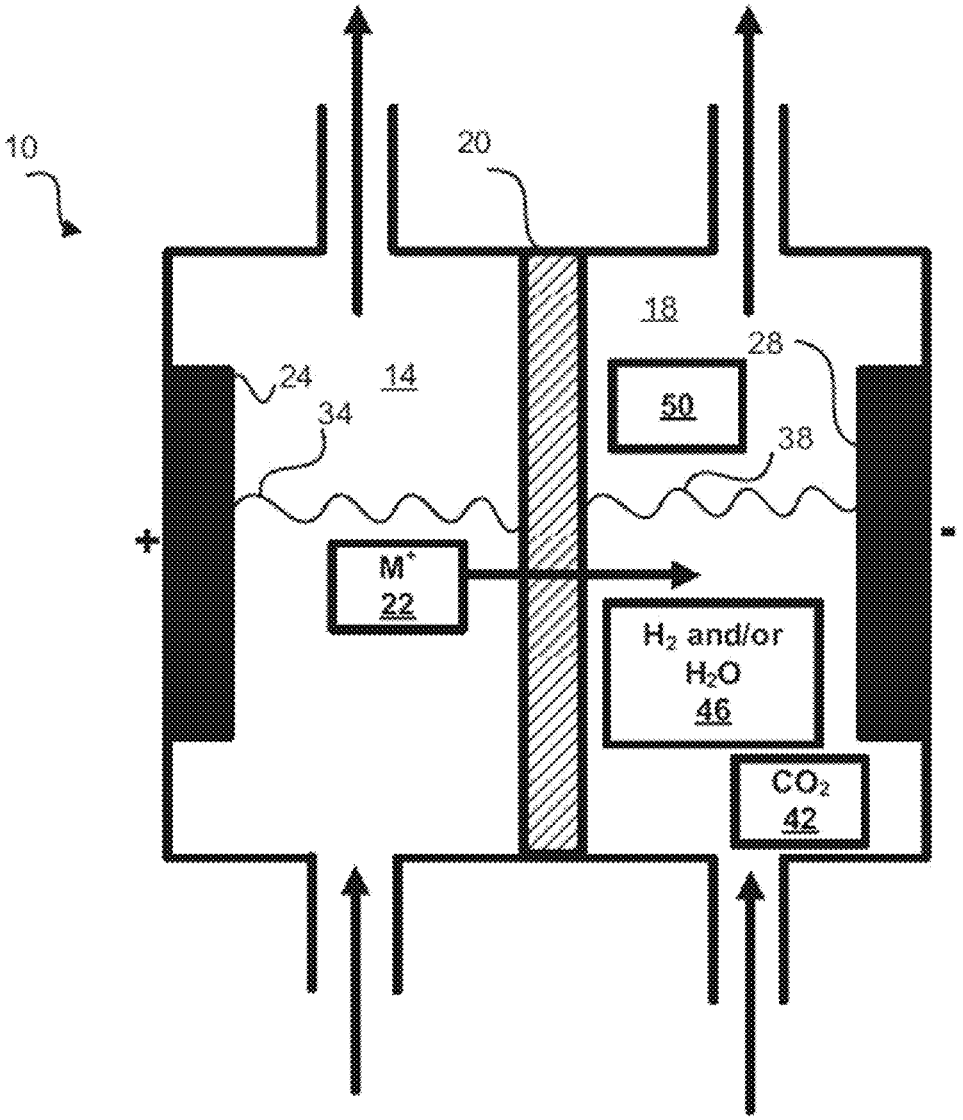
FIG. 1 is a schematic representation of an electrochemical cell that may be used in the present embodiments.

Referring now to FIG. 1, a schematic representation is shown of an electrochemical cell 10 that may be used in the present embodiments. Specifically, the electrochemical cell comprises an anode compartment 14 and a cathode compartment 18. (The anode compartment 14 and the cathode compartment 18 may also be referred to as "anolyte compartment 14" and "catholyte compartment 18.") The anode compartment 14 is separated from the cathode compartment 18 via a membrane 20. In the embodiment shown in FIG. 1, the membrane is a NaSICON membrane.

The membrane 20 is capable of selectively transporting alkali metal cations 22 (designated as "$M^+$") across the membrane 20 from the anode compartment 14 to the cathode compartment 18. More specifically, the membrane 20 is capable of selectively transferring alkali metal ions 22 from the anolyte compartment 14 to the catholyte compartment 18 under the influence of an electrical potential, while preventing the anolyte and the catholyte from mixing. Examples of such solid electrolyte membranes include those based on NaSICON structure, sodium conducting glasses, beta alumina and solid polymeric sodium ion conductors. NaSICON typically has a relatively high ionic conductivity at room temperature. Alternatively, if the alkali metal is lithium, then a particularly well suited material that may be used to construct an embodiment of the membrane is LiSICON. Alternatively, if the alkali metal is potassium, then a particularly well suited material that may be used to construct an embodiment of the membrane is KSICON. Other types of similar membranes that are selective to alkali metal ions may also be used. These different membranes are commercially available from Ceramatec, Inc., of Salt Lake City, Utah.

The cell 10 will generally have an anode 24 and a cathode 28. The anode 24 is housed (at least partially) within the anode compartment 14 while the cathode 28 is housed (at least partially) within the cathode compartment 18.

The particulars of each cell 10 will depend upon the specific embodiment. For example, the cell 10 may be a standard parallel plate cell, where flat plate electrodes and/or flat plate membranes are used. In other embodiments, the cell 10 may be a tubular type cell, where tubular electrodes and/or tubular membranes are used. The anode 24 may comprise, for example, a smooth platinum electrode, a stainless steel electrode, or a carbon based electrode. Examples of a typical carbon based electrode include boron doped diamond, glassy carbon, synthetic carbon, Dimensionally Stable Anodes (DSA) and relatives, and/or lead dioxide. Other electrodes may comprise metals and/or alloys of metals, including S.S, Kovar, Inconel/monel. Other electrodes may comprise $RuO_2$—$TiO_2$/Ti, $PtO_x$—$PtO_2$/Ti, $IrO_x$, $Co_3O_4$, $MnO_2$, $Ta_2O_5$ and other valve metal oxides. In addition, other materials may be used to construct the electrode such as $SnO_2$, $Bi_2Ru_2O_7$ (BRO), $BiSn_2O_7$, noble metals such as platinum, titanium, palladium, and platinum clad titanium, carbon materials such as glassy carbon, BDD, or Hard carbons. Additional embodiments may have $RuO_2$—$TiO_2$, hard vitrems carbon, and/or $PbO_2$. Again, the foregoing serve only as examples of the type of electrodes that may be employed. The material used to construct the cathode 28 may be the same as the material used to construct the anode 24. Other embodiments may be designed in which a different material is used to construct the anode 24 and the cathode 28.

The anode compartment 14 may comprise an anolyte 34. This anolyte 34 may be a liquid material, a gas material, may include solid materials, etc., depending upon the particular embodiment and the particular reactions that are occurring in the anode compartment 14. As shown in FIG. 1, the anolyte 34 comprises a liquid material and may include a quantity of solvent. Likewise, the cathode compartment 18 may comprise a catholyte 38. This catholyte 38 is shown as a liquid (such as, for example, a solvent) but may also include gaseous materials, solid materials, reactants, etc. Specifically, the catholyte 38 may include a quantity of $CO_2$ 42 and hydrogen gas and/or water 46 that will react with the $CO_2$ 42 to produce a valuable chemical/product 50. As $CO_2$ only has a limited solubility in some solvents, the cathode compartment 18 may need to be pressurized in order to conduct the reaction.

The anolyte 34 and the catholyte 38 may be added to the cell 10 via the inlets (as shown by the arrows) and then may be extracted via the outlets (as shown by the arrows). Once extracted, the anolyte/catholyte may be re-introduced into the cell 10 for further reactions. Likewise, the desirable products 50 that are formed in the reaction may also be recovered from the outlets.

The particular reactions that may occur in the cell 10 will now be described. With respect to the anode 24, any reaction may be used, such as for example, reactions of water, hydrogen, oxygen, chloride ions, etc. The particular reactants used on the anode side are isolated from the cathode, so any reaction may be chosen, as desired. The anolyte 34 should comprise (either as a reactant or as an additional electrolyte) a quantity of alkali metal ions 22 that may transport across the membrane 20 during the reaction.

The reactions of the cathode 28 are the reactions that are designed to "fix" the carbon dioxide. The particular reaction that is used to "fix" the carbon dioxide depends upon the reaction conditions, the reactants used, the voltage applied, etc. Some of the following reactions may occur in the cathode:

I. Reactions to Produce Sodium Formate (HCOONa) by Electrochemical Reduction $$CO_2+H_2O+2Na^++2e^-\rightarrow HCOONa+NaOH$$

$$CO_2+\tfrac{1}{2}H_2+e^-+Na^+\rightarrow HCOONa$$

II. Reactions to Produce Sodium Methoxide (Also Known as Sodium Methylate, $CH_3ONa$)

$$CO_2+2H_2+2e^-+2Na^+\rightarrow CH_3ONa+NaOH$$

$$2CO_2+3H_2+2e^-+2Na^+\rightarrow 2CH_3ONa+O_2$$

$$4CO_2+6H_2O+4e^-+4Na^+\rightarrow 4CH_3ONa+5O_2$$

III. Reactions to Produce Carbon Monoxide $$CO_2+H_2O+2e^-+2Na^+\rightarrow CO+2NaOH$$

IV. Reactions to Produce Methane $$CO_2+3H_2+2e^-+2Na^+\rightarrow CH_4+2NaOH$$

V. Reactions to Produce Ethylene ($C_2H_4$)

$$2CO_2+4H_2+4e^-+4Na^+\rightarrow C_2H_4+4NaOH$$

VI. Reactions to Produce Sodium Oxalate ($Na_2C_2O_4$)

$$2CO_2+2e^-+2Na^+\rightarrow Na_2C_2O_4$$

VII. Reactions to Produce Higher Hydrocarbons $$4CO_2+9H_2+8e^-+8Na^+\rightarrow C_4H_{10}+8NaOH$$

Obviously, the voltage/reaction conditions/reactants will determine which of the particular reactions occurs. Further, although the above-recited reactions may show the reaction with hydrogen or water, those skilled in the art will appreciate that hydrogen and water may be used together, as reactants. In some embodiments, water may be used as both the solvent and as a reactant. It should be noted that the solvent chosen for the catholyte may be suitable such that it may dissolve (or at least partially dissolve) the $CO_2$ and/or the hydrogen gas. Those skilled in the art will appreciate how to select a solvent that will have some ability to dissolve $CO_2$. As noted above, the catholyte compartment may also be pressurized to further increase the solubility of the gaseous reactants. It is noted that a tubular NaSICON membrane and/or tubular electrodes have been shown to withstand high pressures. Thus, if the cathode compartment is pressurized, these particular materials may be used. Moreover, in some embodiments, the use of high pressure may force/drive the reaction to produce the desired products. Moreover the solvent/chemicals selected for the solvent in the cathode compartment should be designed such that the $CO_2$ will reduce before the solvent is reduced. In some embodiments the catholyte needs to be designed such that it is stable in the presence of alkali metals.

Once the desirable products 50 are obtained, these products may be separated/isolated, as desired. The cathode may be, for example, an inert metal such as Cu that will react with the $CO_2$ to reduce it (in the presence of $H_2O$ and/or $H_2$).

It will be appreciated that the use of the membrane 20 that isolates the cathode and the anode compartments is beneficial in that the NaSICON prevents the mixing of chemicals from these two chambers (other than alkali metal ions) such that the designer of the cell does not need to worry that the formed chemicals will be oxidized/destroyed by anode reactions. Rather, all that the product must be is "reduction stable"—e.g., stable in the cathode compartment, rather than being stable in both an oxidizing and reducing environment (such as, would occur, for example, in a single compartment cell).

It should be noted that the above-recited reactions are shown using $CO_2$ gas as the reactant which has been added to the cell. However, in other embodiments, it may be desirable to form the $CO_2$ within the cell (e.g., in situ) prior to its reaction. For example, a quantity of aqueous $Na_2CO_3$ (sodium carbonate) may be added to the cathode compartment and allowed/reacted such that it dissociates into carbon dioxide and sodium hydroxide:

$$Na_2CO_3+H_2O \rightarrow CO_2+2NaOH$$

Once this carbon dioxide is formed in situ, it may react in the manner outlined above. Additional embodiments may be designed in which $NaHCO_3$ replaces some or all of the $Na_2CO_3$. In other words, bicarbonate may be used to form the $CO_2$ in situ instead of carbonate.

Further embodiments may be designed in which the input for the catholyte comprises dilute $Na_2CO_3$ and the reaction forms an additional supply of $Na_2CO_3$. Accordingly, the products formed may be concentrated $Na_2CO_3$ that is formed from the reaction of $CO_2$.

Figure 2:
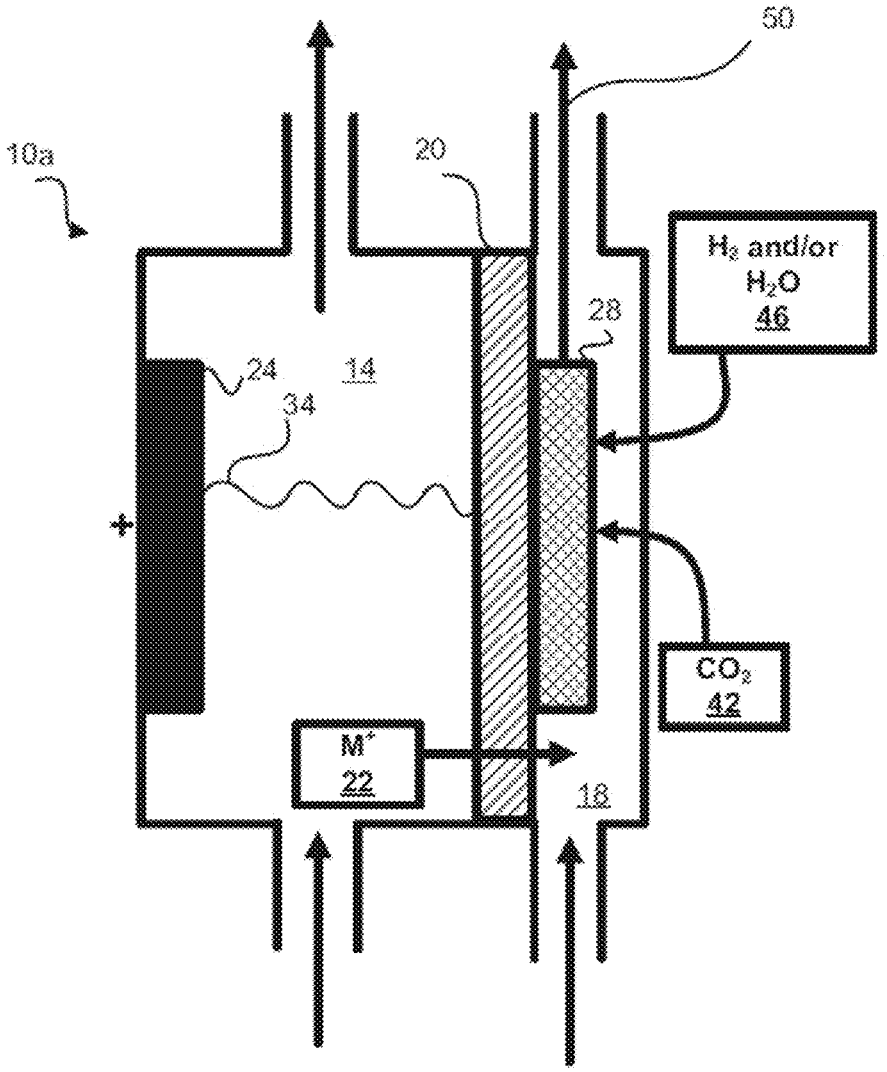
FIG. 2 is a schematic representation of another embodiment of an electrochemical cell.

Referring now to FIG. 2, another embodiment of a cell 10*a* is illustrated. The cell 10*a* may be used to fix carbon dioxide. The cell 10*a* is similar to that which was shown above in FIG. 1. For purposes of brevity, the features/elements of the cell 10*a* that are similar/identical to that which was described in conjunction with FIG. 1 will be omitted.

The main difference between the cell 10*a* and that which was described above is that the cathode 28 comprises a gas diffusion electrode. As is known in the art, a gas diffusion electrode is an electrode that is specifically designed to react gaseous products. As shown in FIG. 2, the gases may designed such that they will contact the rear side of the electrode and may react on the electrode (or on a surface of the electrode). The gas diffusion electrode may be used in those situations where there is limited solubility of one or more of the gases within the catholyte solvent.

Moreover, the cathode shown in FIG. 2 is placed at or near (or even on) the membrane 20. This position may operate to help speed the reaction kinetics and may reduce (and/or eliminate) the amount of solvent that is needed in the catholyte.

Figure 3:
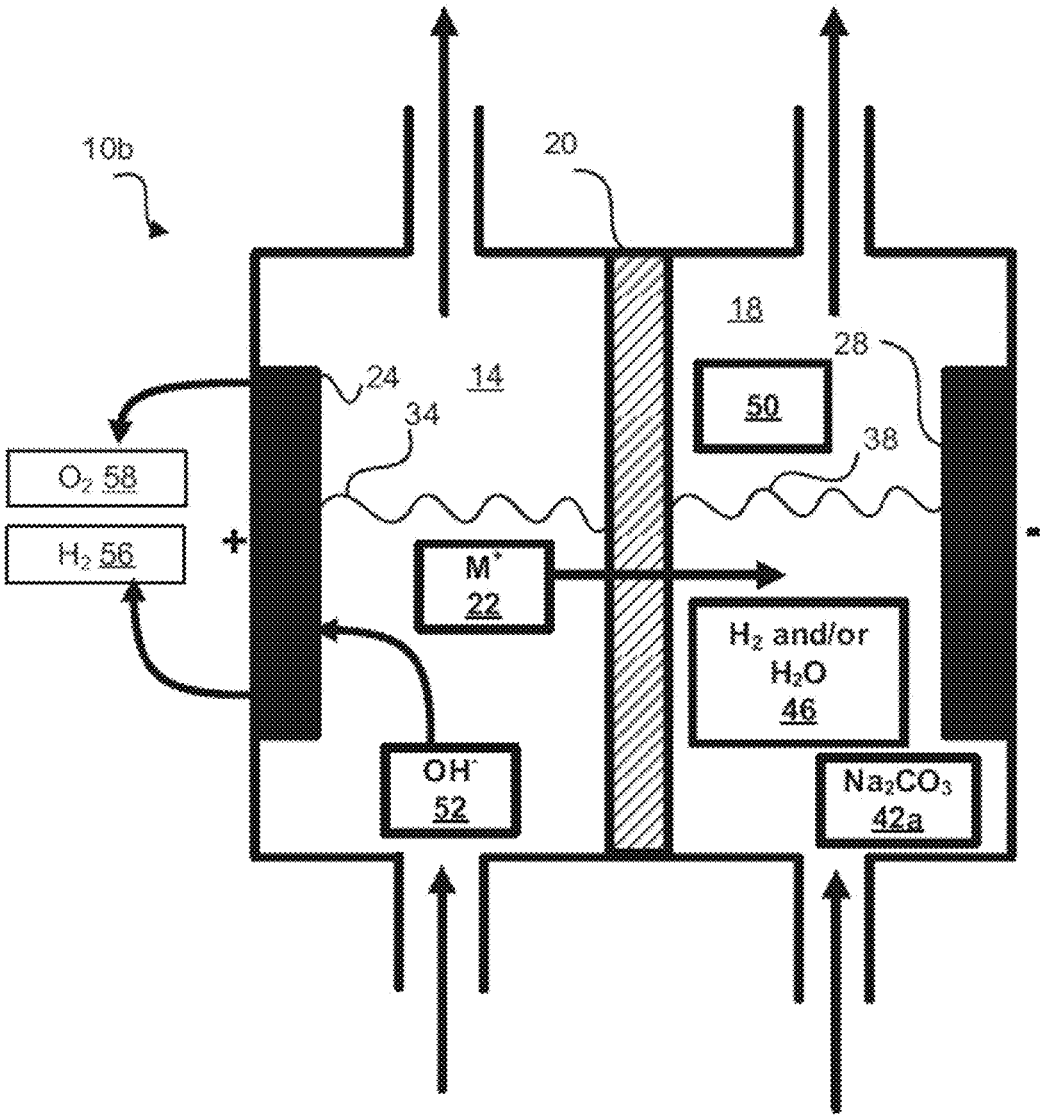
FIG. 3 is a schematic representation of a further embodiment of an electrochemical cell.

Referring now to FIG. 3, a further embodiment is disclosed. Specifically, FIG. 3 is similar to that which is shown in FIG. 1. However, FIG. 3 shows a cell 10*b* in which the catholyte 38 comprises $Na_2CO_3$ 42*a* instead of carbon dioxide. (In other embodiments, the $Na_2CO_3$ may be used in addition to carbon dioxide.) Thus, comprises $Na_2CO_3$ 42*a* will be fed into the catholyte solution. (In further embodiments, the $Na_2CO_3$ may also be used in conjunction with the gas diffusion electrode of FIG. 2.) The products of FIG. 3 will be dilute $Na_2CO_3$ (in addition to organic products), as opposed to the concentrated solution of $Na_2CO_3$ that was initially obtained.

The anolyte of FIG. 3 is shown as having a concentration of $M^+$ ions from an electrolyte such as NaOH, NaCl, etc. The anode 24 in FIG. 3 is shown as an oxygen electrode that reacts as follows:

$$2OH^- \rightarrow H_2+O_2+2e^-$$

Thus, the $OH^-$ 52 in the electrolyte forms two electrons may then be transmitted and used in the cathode reaction. Likewise, the $Na^+$ ($M^+$) ions will also transfer across the membrane 20. The anode also forms $H_2$ 56 and $O_2$ 58. It should be appreciated to those skilled in the art that the $H_2$ produced in the anode compartment may be used in the cathode compartment.

Figure 4:
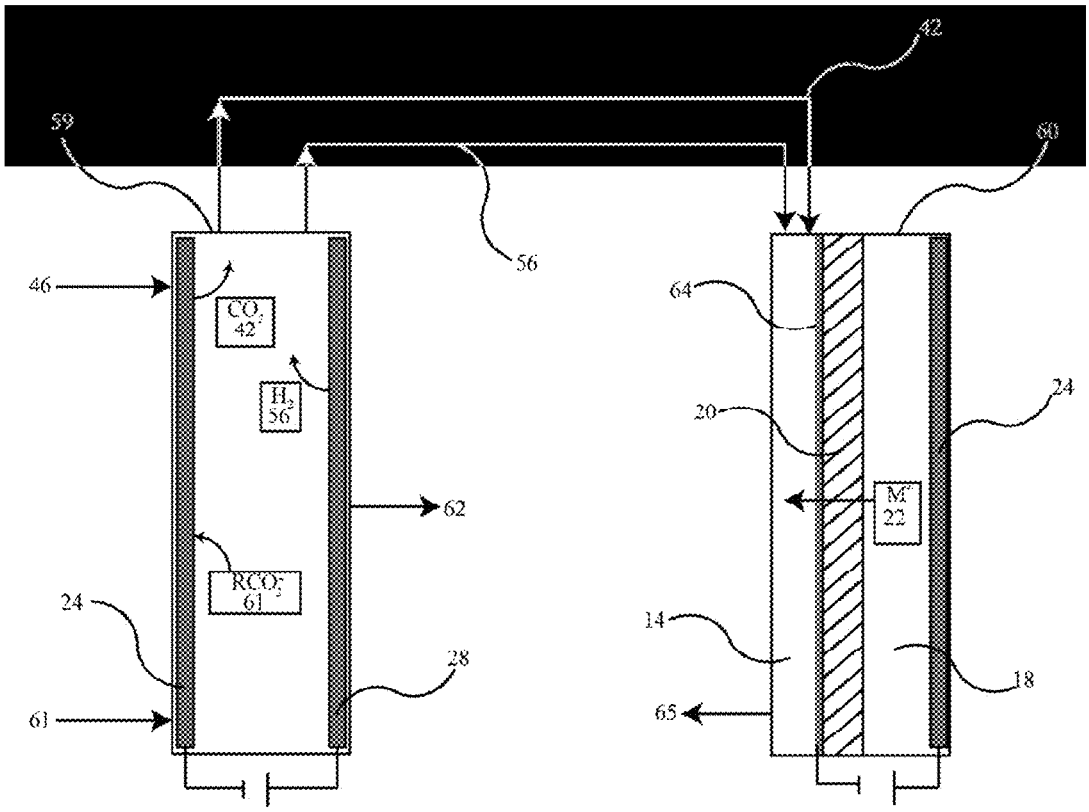
FIG. 4 is a schematic representation of a process flow for a two electrochemical cell process that converts $CO_2$ into hydrocarbons.

Referring now to FIG. 4, in one embodiment the cathode is a molten alkali metal 64. In such an embodiment the alkali metal ions 22 are transferred from the anolyte through the membrane 20 to the cathode compartment 14 where they are reduced to alkali metal 64. The carbon dioxide 42 is then reduced when it makes contact to the alkali metal 64. The carbon dioxide 42 can make contact to the alkali metal in gas form or as a gas dissolved in an electrolyte, where the electrolyte is in contact with the alkali metal. Hydrogen 56 may also be present in the catholyte chamber 14 with the carbon dioxide 42. The reaction of the carbon dioxide 42 with sodium metal 64 and hydrogen 56 may lead to the formation of paraffinic or olefinic hydrocarbons 65 and alkali oxides. The temperature of the cell may be higher than the boiling point of the hydrocarbons 65 produced, and the hydrocarbons 65 are removed from the cell as a gas. Also, the temperature of the cell may be lower than the boiling point of the hydrocarbons 65 produced, and the hydrocarbons are physically separated from the alkali metal 64 during the reaction.

FIG. 4 also shows an embodiment of the present invention where the carbon dioxide 42 is produced by one electrochemical cell 59 and then is transferred to a second electrochemical cell 60 where the reduction of the $CO_2$ is performed. A process diagram for such an embodiment is shown in FIG. 4. The first electrochemical cell 59 may also be a two compartment cell, where the compartments are separated by a membrane (such as a NaSICON membrane), it may also be a one compartment cell. The production of $CO_2$ 42 in the first electrochemical cell may be from the decarboxylation of carboxylic acids or of alkali salts 61 thereof. In this electrolysis the $CO_2$ 42 is a side product of the conversion of carboxylic acids 61 into hydrocarbons. Thus, the first electrochemical cell may produce a chemical of value 62 and the $CO_2$ 42 required for the second electrochemical cell 60. It will be appreciated by those skilled in art that there are a variety of carboxylic acids 61 that can be converted into a variety of hydrocarbons 62, for example carboxylic acids 61 derive from biomass can be converted into biochemicals 62. In embodiments where the first electrochemical cell 59 is a one compartment cell the reduction reaction may be the reduction of water 46 producing hydrogen 63, which can also be transferred along with the $CO_2$ 42 to the second electrochemical cell 60 for the reduction of $CO_2$ 42. In embodiments where the first electrochemical cell 59 is a two compartment cell, the reduction of water may be carried out in the anode compartment of the cell and the resulting hydrogen 63 can be transferred to the second electrochemical cell 60 separate from the $CO_2$.

In the embodiments for which the carbon dioxide is reduce using an alkali metal, those skilled in the art will appreciate that choice of alkali metal and its potential may determine the hydrocarbon product obtained. It will also be appreciated by those skilled in the art that the use of the NaSICON type membrane 20 permits the production of the alkali metal 64 on the cathode side of the cell, using a variety of chemistry on the anode side 18 of the cell, such as aqueous electrolysis.

The following reaction may occur in the cathode:

VIII. Reactions Using Alkali Metal Reducing Agent $$nCO_2+n+1H_2+4nM \rightarrow C_nH_{2n+2}+2nM_2O$$

$$nCO_2+nH_2+4nM \rightarrow C_nH_{2n}+2nM_2O$$

Thus, depending upon the particular reactants, voltages, conditions, etc., the present embodiments operate to convert carbon dioxide into one or more of the following chemicals (in an electrochemical cell):

formate;
methoxide;
carbon monoxide;
methane;
ethylene;
oxalate;
paraffinic and olefinic hydrocarbons (such as butane or butene).

EXAMPLES

Several examples will be given to demonstrate the technical feasibility of the embodiments of the present invention. The examples demonstrate the reduction of carbon dioxide using an alkali metal in the presence of hydrogen producing paraffinic and olefinic hydrocarbons. The examples also demonstrate that the source of carbon dioxide can come from a variety of sources, in the examples presented it is produced electrochemically during the decarboxylation of sodium carboxylates producing hydrocarbons which in themselves are valuable chemicals.

The examples of the present invention will involve the reduction of $CO_2$ on the surface of sodium metal. The reaction of the $CO_2$ was performed in a round bottom flask that contained freshly prepared slivers of sodium metal. The sodium metal was prepared in an argon glovebox and sealed in the round bottom flask before being connected to the electrolysis cell. The $CO_2$ and $H_2$ gas produced from the electrolysis of sodium carboxylates was directed into the round bottom flask where it could react with the sodium metal. Columns were placed between the electrolysis cell and the round bottom flask containing to remove any water or oxygen from the gas stream. Any remaining gas or overflow from the round bottom flask was vented through a bubbler. Upon completion of the decarboxylation, the products were extracted from the sodium metal using hydrocarbon solvents.

Example 1

Figure 5:
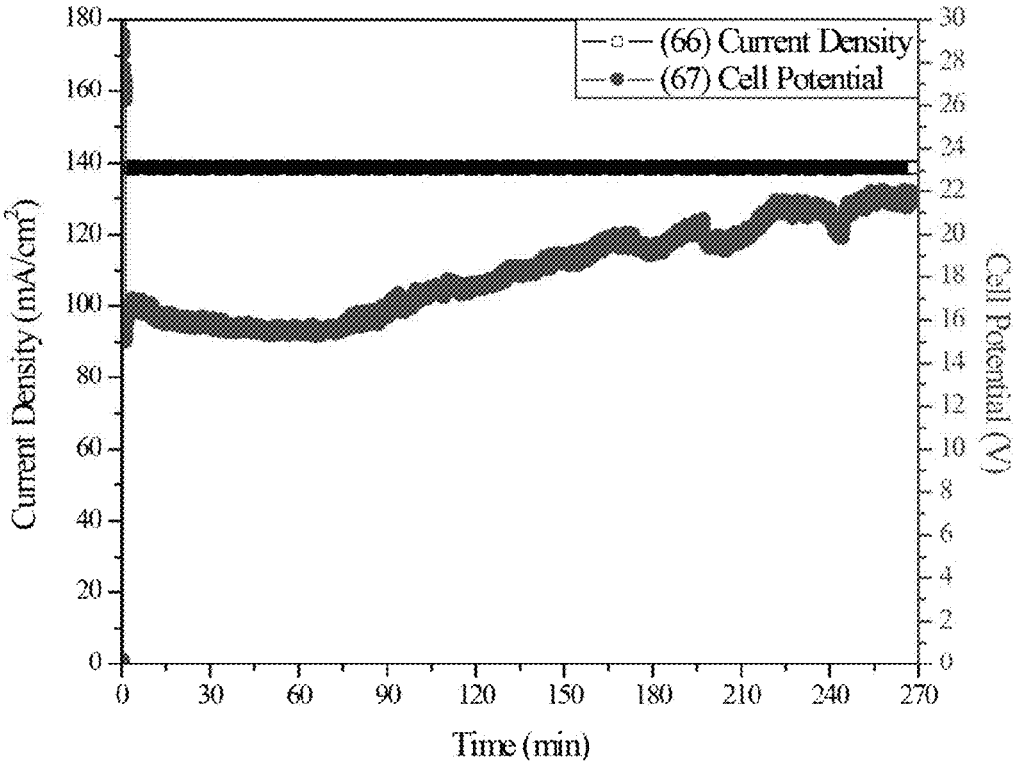
FIG. 5 is a graph showing the cell potential and current density of the decarboxylation of sodium octanoate, producing $CO_2$ and $H_2$.
Figure 6:
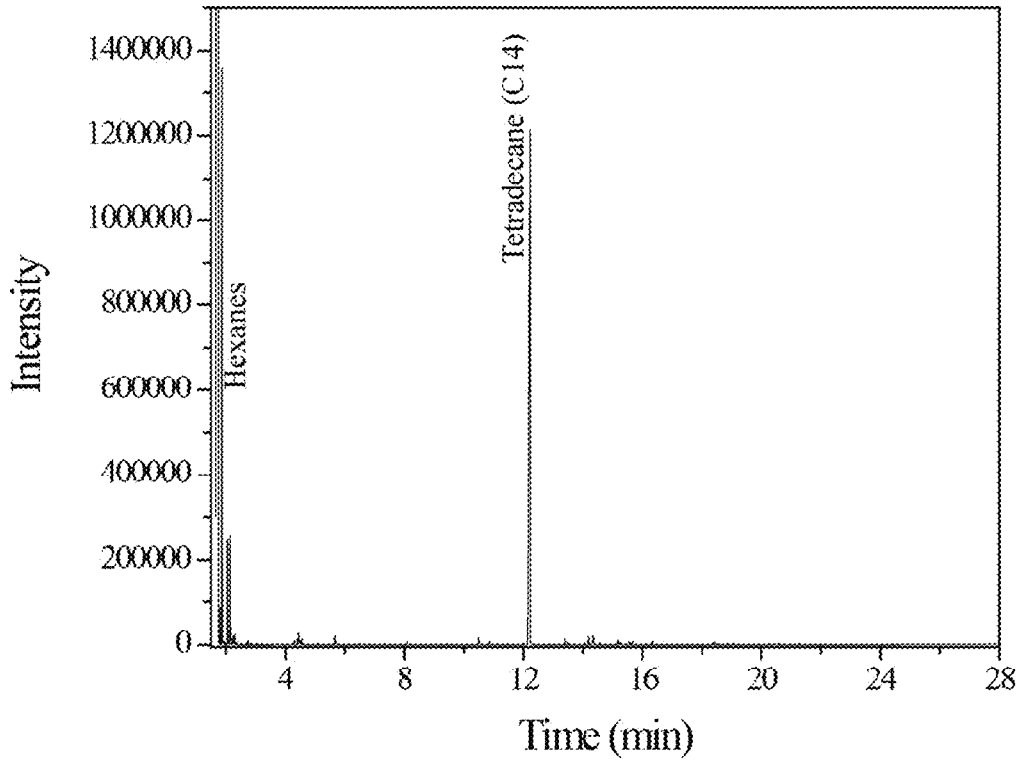
FIG. 6 is a gas chromatogram showing the conversion of sodium octanoate to tetradecane.
Figure 7:
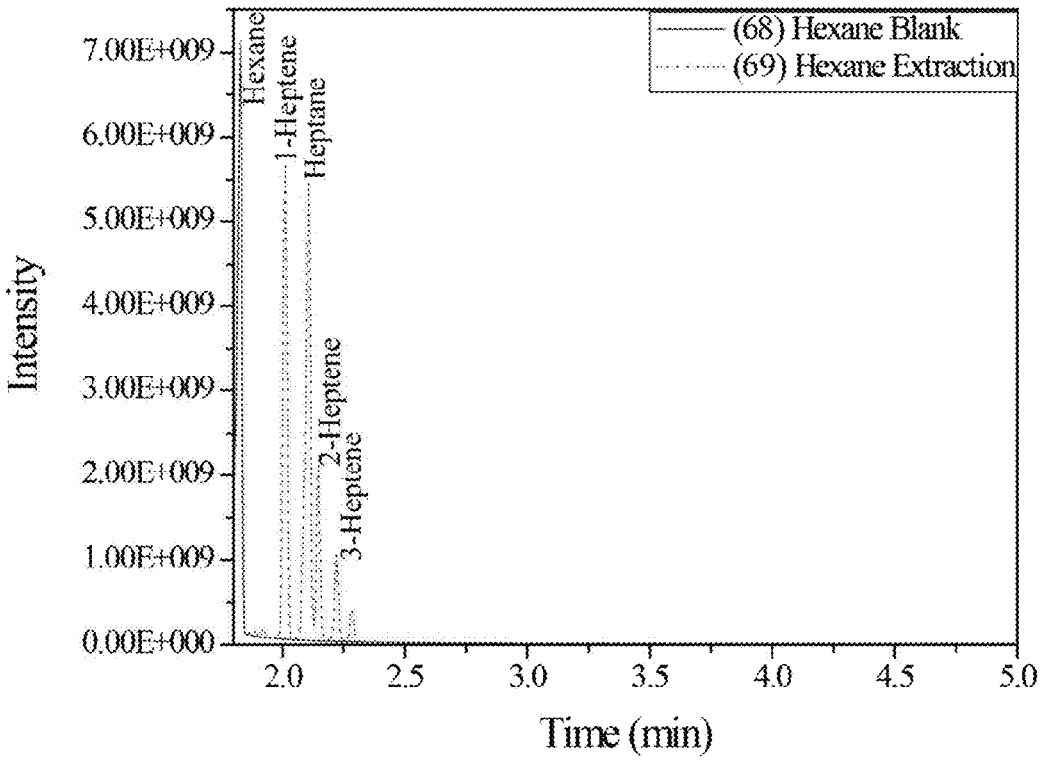
FIG. 7 is a gas chromatogram-mass spectroscopy showing the hexane extraction of the hydrocarbon products produce by the reaction of $CO_2$ and $H_2$ with sodium metal.

For this example, sodium metal was reacted with carbon dioxide and hydrogen that was produced in a single compartment decarboxylation cell. The cell contained an aqueous/methanol electrolyte with 10% sodium octanoate, and was run at room temperature and a constant current density of 140 mA/cm$^2$ and between 15-22 V. The current density 66 and cell potential 67 can be seen in FIG. 5. The electrolysis converted the sodium octanoate into tetradecane, as seen in GC shown in FIG. 6, demonstrating that $CO_2$ and $H_2$ were produced. The $CO_2$ and $H_2$ exhaust from the electrolysis was piped into the round bottom flask containing the sodium metal. During the electrolysis the surface of the sodium metal changed from shiny metallic in appearance to a dull brown purple color. Upon completion, hexane was added to the round bottom flask and the slivers of sodium metal were stirred overnight in the hexane. After stirring overnight in hexane the shiny metallic appearance of the sodium metal was restored, and GC-MS was used to analysis the hexane solution. As seen in FIG. 7, the reduction of $CO_2$ on the surface of metallic sodium in the presence of hydrogen produced a mixture of heptane and heptenes.

Example 2

Figure 8:
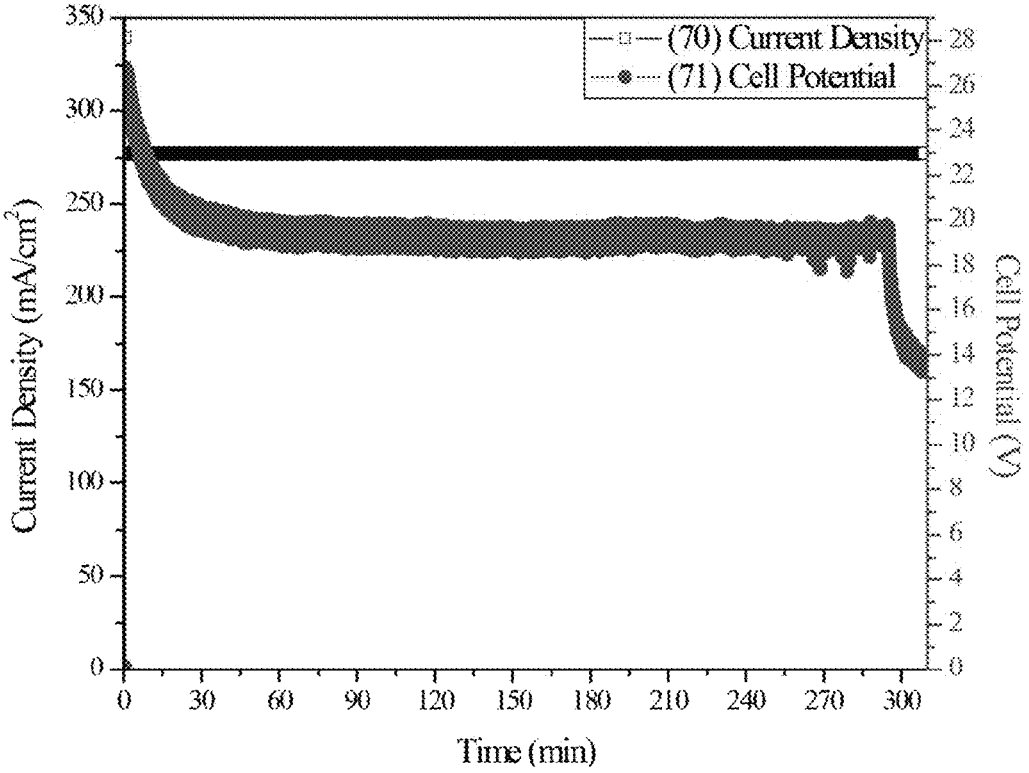
FIG. 8 is a graph showing the cell potential and current density of the decarboxylation of sodium laurate, producing $CO_2$ and $H_2$.
Figure 9:
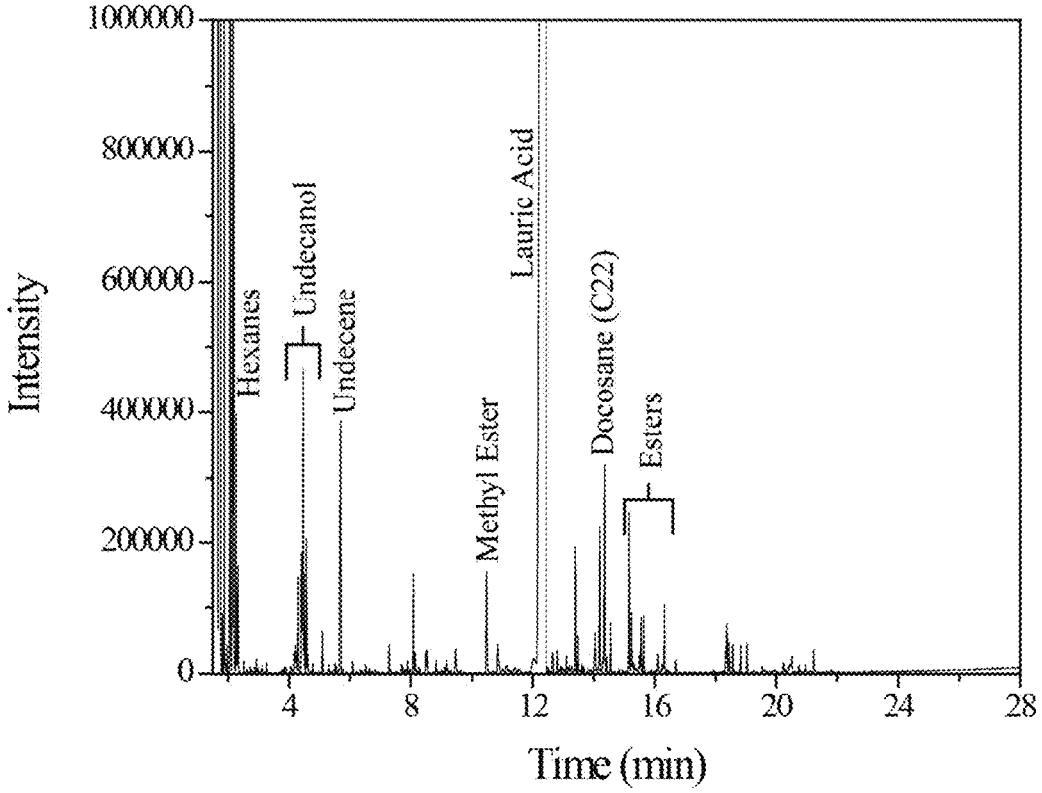
FIG. 9 is a gas chromatogram showing the conversion of sodium laurate to docosane.
Figure 10:
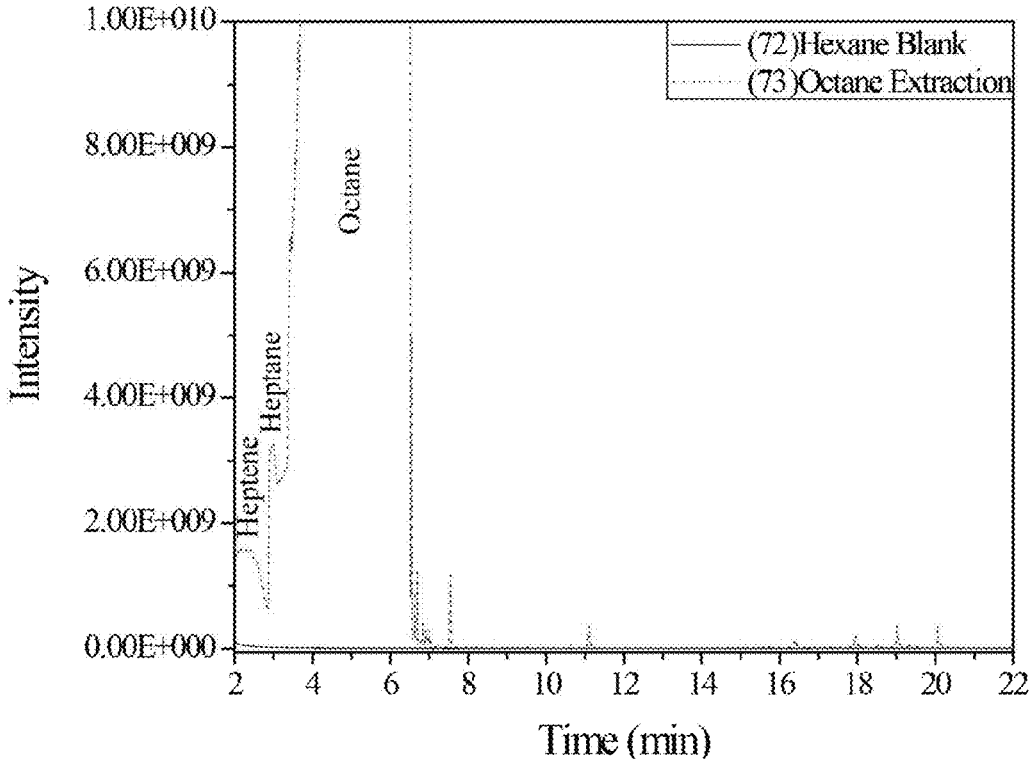
FIG. 10 is a gas chromatogram showing octane extraction of the hydrocarbon products produce by the reaction of $CO_2$ and $H_2$ with sodium metal.

For this example, the decarboxylation of sodium laurate was used to produce the carbon dioxide and hydrogen that was reacted with the sodium metal. The electrochemical cell contained an aqueous/methanol electrolyte with 10% sodium laurate, and was run at room temperature and a constant current density of 275 mA/cm$^2$ and 12-22 V. The current density 70 and cell potential 71 can be seen in FIG. 8. This electrolysis converted the sodium laurate into docosane, as seen in FIG. 9 verifying $CO_2$ and $H_2$ were produced by the electrolysis. The gases from this electrolysis were directed into the round bottom flask containing the sodium metal. After the electrolysis was terminated the surface of the sodium metal changed from shiny metallic in nature to a dull brown purple color. Octane was added to the round bottom flask and the sodium metal was stirred overnight in the octane. After stirring overnight, the surface of the sodium metal regained its shiny metallic appearance, and GC-MS was used to analysis the octane solution. As seen in FIG. 10, the reduction of $CO_2$ on the surface of metallic sodium in the presence of hydrogen also produced a mixture of heptane and heptenes.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. An electrochemical cell comprising:

an anode compartment that at least partially houses an anode;

a cathode compartment that at least partially houses a cathode, the cathode comprising a molten alkali metal, and wherein the cathode compartment further comprises carbon dioxide gas and hydrogen gas, wherein the carbon dioxide gas and hydrogen gas react with the alkali metal according to one of the following reactions:

$$nCO_2+(n+1)H_2+4nM \rightarrow C_nH_{2n+2}+2nM_2O \text{ or}$$

$$nCO_2+nH_2+4nM \rightarrow C_nH_{2n}+2nM_2O;$$

wherein M is the alkali metal;

a NaSICON membrane that separates the anode compartment from the cathode compartment, wherein the NaSICON membrane selectively transfers sodium ions from the anode compartment to the cathode compartment during electrochemical reactions in the electrochemical cell.

2. The electrochemical cell as in claim 1, wherein the cathode compartment is pressurized.

3. The electrochemical cell as in claim 1, wherein the carbon dioxide is produced in a second electrochemical cell.

4. The electrochemical cell as in claim 1, wherein the cathode compartment comprises a solvent that at least partially dissolves the carbon dioxide gas.

5. The electrochemical cell as in claim 1, wherein the carbon dioxide gas, the hydrogen gas, and the alkali metal cathode are reacted to form one or more of the following: ethane, ethene, propane, propene, butane, butene, pentane, pentene, hexane, hexene, heptane, heptene, octane, octene, nonane, nonene, decane, and decene.

6. The electrochemical cell as in claim 2, wherein the carbon dioxide gas is a gas that is added to the cathode compartment.

7. The electrochemical cell as in claim 2, wherein the cathode compartment further comprises sodium carbonate or sodium bicarbonate.

* * * * *